US007008889B2

(12) United States Patent
Black et al.

(10) Patent No.: US 7,008,889 B2
(45) Date of Patent: Mar. 7, 2006

(54) IMAGED NONWOVEN FABRIC COMPRISING LYOCELL FIBERS

(75) Inventors: Samuel K. Black, Raleigh, NC (US); Sergio De Leon, Clayton, NC (US)

(73) Assignee: Polymer Group, Inc., North Charleston, SC (US)

( * ) Notice: Subject to any disclaimer, the term of this patent is extended or adjusted under 35 U.S.C. 154(b) by 0 days.

(21) Appl. No.: 10/236,676

(22) Filed: Sep. 6, 2002

(65) Prior Publication Data

US 2003/0143912 A1 Jul. 31, 2003

Related U.S. Application Data

(60) Provisional application No. 60/317,991, filed on Sep. 7, 2001.

(51) Int. Cl.
*D04H 1/48* (2006.01)
*D04H 1/58* (2006.01)

(52) U.S. Cl. ..... 442/384; 442/408; 28/104; 156/148

(58) Field of Classification Search ..... 156/148; 28/104; 442/384, 408
See application file for complete search history.

(56) References Cited

U.S. PATENT DOCUMENTS 3,485,706 A 12/1969 Evans
4,869,771 A * 9/1989 LeVan ..... 156/289
5,098,764 A 3/1992 Drelich et al.
5,225,242 A * 7/1993 Frankosky et al. ..... 427/209
5,240,764 A * 8/1993 Haid et al. ..... 442/408
5,244,711 A 9/1993 Drelich et al.
5,311,389 A 5/1994 Howey
5,822,823 A 10/1998 Polzin et al.
5,827,597 A 10/1998 James et al.
5,870,807 A 2/1999 Beaty et al.
5,928,973 A 7/1999 Daniel et al.
6,163,943 A * 12/2000 Johansson et al. ..... 28/104
6,210,801 B1 4/2001 Luo et al.
6,235,392 B1 5/2001 Juo et al.
6,358,461 B1 3/2002 Law et al.

FOREIGN PATENT DOCUMENTS

JP 10037059 2/1998
WO WO 99/64649 12/1999
WO WO 00/78882 A1 12/2000

* cited by examiner

*Primary Examiner*—Sam Chuan Yao
(74) *Attorney, Agent, or Firm*—Wood, Phillips, Katz, Clark & Mortimer

(57) ABSTRACT

A method of forming durable nonwoven fabrics by hydroentanglement includes providing a precursor web comprising a blend of matrix fibers, lyocell fibers, and fusible binder fibers. The precursor web is subjected to hydroentanglement on a three-dimensional image transfer device to create a patterned and imaged fabric. Fabrics formed in accordance with the present invention exhibit significant improvements in strength while remaining drapeable and are capable of withstanding multiple laundry washing with nominal shrinkage.

4 Claims, 1 Drawing Sheet

IMAGED NONWOVEN FABRIC COMPRISING LYOCELL FIBERS

TECHNICAL FIELD

The present invention is directed to nonwoven fabrics, and more particularly to nonwoven fabrics comprised of a blend of matrix fibers, lyocell fibers and fusible binder fibers, the nonwoven fabric being formed on a three-dimensional image transfer device and exhibiting a durable, drapeable performance.

BACKGROUND OF THE INVENTION

The production of conventional textile fabrics is known to be a complex, multi-step process. The production of fabrics from staple fibers begins with the carding process where the fibers are opened and aligned into a feedstock known as sliver. Several strands of sliver are then drawn multiple times on a drawing frames to further align the fibers, blend, improve uniformity as well as reduce the sliver's diameter. The drawn sliver is then fed into a roving frame to produce roving by further reducing its diameter as well as imparting a slight twist. The roving is then fed into the spinning frame where it is spun into yarn. The yarns are next placed onto a winder where they are transferred into larger packages. The yarn is then ready to be used to create a fabric.

For a woven fabric, the yarns are designated for specific use as warp or fill yarns. The fill yarns (which run on the y-axis and are known as picks) are taken straight to the loom for weaving. The warp yarns (which run on the x-axis and are known as ends) must be further processed. The large packages of yarns are placed onto a warper frame and are wound onto a section beam were they are aligned parallel to each other. The section beam is then fed into a slasher where a size is applied to the yarns to make them stiffer and more abrasion resistant, which is required to withstand the weaving process. The yarns are wound onto a loom beam as they exit the slasher, which is then mounted onto the back of the loom. The warp yarns are threaded through the heedels of the loom, which raises and lowers the individual yarns as the filling yarns are inserted perpendicular in an interlacing pattern thus weaving the yarns into a fabric. Once the fabric has been woven, it is necessary for it to go through a scouring process to remove the size from the warp yarns before it can be dyed or finished. Currently, commercial high speed looms operate at a speed of 1000 to 1500 picks per minute, where a pick is the insertion of the filling yarn across the entire width of the fabric. Sheeting and bedding fabrics are typically counts of 80×80 to 200×200, being the ends per inch and picks per inch, respectively. The speed of weaving is determined by how quickly the filling yarns are interlaced into the warp yarns, therefore looms creating bedding fabrics are generally capable of production speeds of 5 inches to 18.75 inches per minute.

In contrast, the production of nonwoven fabrics from staple fibers is known to be more efficient than traditional textile processes as the fabrics are produced directly from the carding process.

Nonwoven fabrics are suitable for use in a wide variety of applications where the efficiency with which the fabrics can be manufactured provides a significant economic advantage for these fabrics versus traditional textiles. However, nonwoven fabrics have commonly been disadvantaged when fabric properties are compared, particularly in terms of surface abrasion, pilling and durability in multiple-use applications. Hydroentangled fabrics have been developed with improved properties that are a result of the entanglement of the fibers or filaments in the fabric providing improved fabric integrity. Subsequent to entanglement, fabric durability can be further enhanced by the application of binder compositions and/or by thermal stabilization of the entangled fibrous matrix.

U.S. Pat. No. 3,485,706, to Evans, hereby incorporated by reference, discloses processes for effecting hydroentanglement of nonwoven fabrics. More recently, hydroentanglement techniques have been developed which impart images or patterns to the entangled fabric by effecting hydroentanglement on three-dimensional image transfer devices. Such three-dimensional image transfer devices are disclosed in U.S. Pat. No. 5,098,764, hereby incorporated by reference, with the use of such image transfer devices being desirable for providing a fabric with enhanced physical properties as well as an aesthetically pleasing appearance.

For specific applications, a nonwoven fabric must exhibit a combination of specific physical characteristics. For example, fabrics used in the home should be soft and drapeable, yet withstand home laundering, and be resistant to abrasion (which can result in fabric pilling). Fabrics used in the home must also exhibit sufficient strength and tear resistance, and colorfastness. These are among the characteristics which have been identified as being desirable for so-called "top-of-the-bed" applications, such as comforters, pillows, dust ruffles, and the like.

Heretofore, attempts have been made to develop nonwoven fabrics exhibiting the necessary aesthetic and physical properties through the use of specialized lyocell fibers. Lyocell is a natural cellulosic fiber spun from an amine oxide solvent developed by American ENKA, Asheville, N.C. in the late 1970's. U.S. Pat. No. 6,210,801, and U.S. Pat. No. 6,235,392, incorporated herein by reference, detail useful cellulosic compositions and the method of spinning such lyocell fibers. Courtaulds Fibers Inc. of Axis, Ala. ("Courtaulds") markets lyocell fiber under the brand name of TENCEL in lengths suitable for short-staple and worsted and woolen spinning systems. TENCEL fibers has a highly crystalline structure and is fabricated from an amine oxide solvent of N-methylmorpholine N-oxide, commonly referred to as NMMO. The industry has found that TENCEL materials are superior to other cellulosics, including cotton and rayon in tensile and aesthetic properties which make it suitable for use in the textile field.

Various attempts have been made to fabricate lyocell fabrics with enhanced physical properties. Published Japanese Patent Application No. 10037059, discloses a method of forming a lyocell-based fabric comprising a lyocell filament yarn, whereby fibrillation of the lyocell under high pressure acts to interlace the yarn into a web construction. Published PCT Applications No. 98/26122 and 99/64649, are directed to a continuous extrusion process whereby lyocell filaments are formed and collected as a fiber web. U.S. Pat. No. 5,870,807, incorporated herein by reference, teaches to a "hydroenhancement" procedure whereby a pre-existing woven lyocell fabric is subjected to wet-processing and enzymatic hydrolysis treatments.

Notwithstanding various attempts in the prior art to develop a nonwoven fabric acceptable for home use applications, a need continues to exist for a nonwoven fabric which provides the desired softness and drapeability, as well as the requisite mechanical characteristics.

SUMMARY OF THE INVENTION

The present invention is directed to nonwoven fabrics, and more particularly to nonwoven fabrics comprised of a blend of matrix fibers, lyocell fibers and fusible binder fibers, the nonwoven fabric being formed on a three-dimensional image transfer device and exhibiting a durable, drapeable performance. In particular, the present invention contemplates that a nonwoven fabric is formed from a precursor fibrous web, which is subjected to hydroentanglement on a moveable imaging surface of the three-dimensional image transfer device, and dried to heat-bond the fabric bond. Enhanced physical performance is obtained in the matrix/lyocell/binder fiber nonwoven fabric due to the synergistic effect of the fibrous components and the ability of surface asparities comprising the face of the three-dimensional image transfer device to focus the hydraulic energy into the formation of the fabric.

In accordance with the present invention, a method of making a nonwoven fabric embodying the present invention includes the steps of providing a precursor web comprising a fibrous matrix. While use of staple length fibers is typical, the fibrous matrix may comprise substantially continuous filaments. In a particularly preferred form, the fibrous matrix is carded, and optionally cross-lapped, to form a precursor web. It is also preferred that the precursor web be subjected to pre-entangling on a foraminous forming surface prior to imaging and patterning.

The present method further contemplates the provision of a three-dimensional image transfer device having a movable imaging surface. In a typical configuration, the image transfer device may comprise a drum-like apparatus which is rotatable with respect to one or more hydroentangling manifolds.

The precursor web is advanced onto the imaging surface of the image transfer device so that the web moves together with the imaging surface. Hydroentanglement of the precursor web is effected to form an imaged and patterned fabric.

Subsequent to hydroentanglement, the imaged and patterned fabric may be subjected to one or more variety of post-entanglement treatments. Such treatments may include application of a polymeric binder composition, mechanical compacting, application of a flame-retardant composition, dyeing and printing and like processes.

A further aspect of the present invention is directed to a method of forming a durable nonwoven fabric, which exhibits a sufficient degree of softness and drapeability, while providing the necessary resistance to tearing and abrasion, to facilitate use in a wide variety of applications. The fabric exhibits a significant degree of launderability, thus permitting its use in those applications in which the fabric may become soiled, and thus require home laundering.

A method of making the present durable nonwoven fabric comprises the steps of providing a precursor web that is subjected to hydroentangling. A polyester/lyocell/polyester binder fiber blend has been found to desirably yield soft hand and good fabric drapeability. The precursor web is formed into an imaged and patterned nonwoven fabric by hydroentanglement on a three-dimensional image transfer device. The image transfer device defines three-dimensional elements against which the precursor web is forced during hydroentangling, whereby the fibrous constituents of the web are imaged and patterned by movement into regions between the three-dimensional elements of the transfer device.

In the preferred form, the precursor web is hydroentangled on a foraminous surface prior to hydroentangling on the image transfer device. This pre-entangling of the precursor web acts to integrate the fibrous components of the web, but does not impart imaging and patterning as can be achieved through the use of the three-dimensional image transfer device.

Other features and advantages of the present invention will become readily apparent from the following detailed description, the accompanying drawings, and the appended claims.

DETAILED DESCRIPTION

Figure 1:
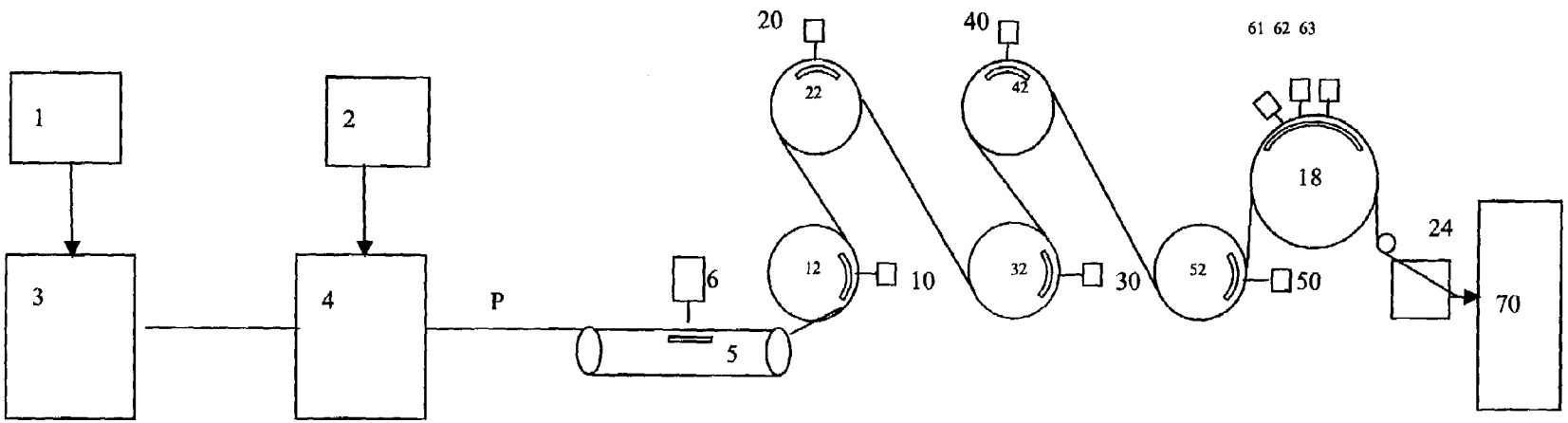
FIG. 1 is a diagrammatic view of an apparatus for manufacturing a durable nonwoven fabric, embodying the principles of the present invention.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiment illustrated.

In accordance with the present invention, a durable nonwoven fabric can be produced from a mixture of matrix, lyocell and binder fibers, which can be employed in bedding applications, with the fabric exhibiting sufficient wash durability, softness, drapeability, abrasion resistance, strength, and tear resistance.

Because nonwoven fabrics are frequently produced using staple length fibers, the fabric typically has a degree of exposed surface fibers that will abrade or "pill" if not sufficiently entangled, and/or not treated with the appropriate polymer chemistries subsequent to hydroentanglement. The present invention provides a finished fabric that can be cut, sewn, and packaged for retail sale. The cost associated with designing/weaving, fabric preparation, dyeing and finishing steps can be desirably reduced.

With particular reference to FIG. 1, therein is illustrated an apparatus for practicing the method of the present invention for forming a nonwoven fabric. The fabric is formed from a fibrous matrix, which comprises fibers selected to promote economical manufacture, and desired physical properties (minimum wash shrinkage, minimum thermal shrinkage, higher tear strength, and higher tensile strengths) for the resultant fabric. The fibrous matrix is preferably carded and subsequently cross-lapped to form a precursor web, designated P.

FIG. 1 illustrates a hydroentangling apparatus for forming nonwoven fabrics in accordance with the present invention. The apparatus includes a foraminous forming surface in the form of a flat bed entangler 5 upon which the fibrous precursor web P is positioned for pre-entangling. Precursor web P is then sequentially passed under entangling manifolds 12, 22, 32, 42, 52, whereby the precursor web is subjected to high-pressure water jets. This process is well known to those skilled in the art and is generally taught by U.S. Pat. No. 3,485,706, to Evans, hereby incorporated by reference.

The entangling apparatus of FIG. 1 further includes an imaging and patterning drum 18 comprising a three-dimensional image transfer device for effecting imaging and patterning of the now-entangled precursor web. After pre-entangling, the precursor web is directed to the image transfer device 18, where a three-dimensional image is imparted into the fabric on the foraminous forming surface of the device. The web of fibers is juxtaposed to the image transfer device 18, and high pressure water from manifolds 61,62, and 63, is directed against the outwardly facing surface from jet spaced radially outwardly of the image transfer device 18. The image transfer device 18, and manifolds 61, 62, and 63, may be formed and operated in accordance with the teachings of commonly assigned U.S. Pat. No. 5,098,764, No. 5,244,711, No. 5,822,823, and No. 5,827,597, the disclosures of which are hereby incorporated by reference. It is presently preferred that the precursor web P be given a three-dimensional image suitable to provide fluid management, as will be further described, to promote use of the present nonwoven fabric in durable goods. The entangled fabric can be vacuum dewatered at 24, and dries at an elevated temperature through drum dryers. By drying the fabric, the nonwoven fabric is at least partially heat-bonded. This occurs as a result of the binder fibers fusing to each other and/or fusing to the other fibrous components.

The fibrous precursor web P is formed from a blend of matrix fiber in the range of about 50% to about 75% by weight, lyocell fiber in the range of about 20% to about 45% by weight, and binder fiber in the range of about 3% to about 20% by weight. A preferred range of binder fiber is in the range of 5% to 10% by weight.

The matrix fibers that can be used include those of both synthetic and natural composition, of an infinite fiber length, a finite staple length or a natural fiber length. Synthetic fibers include those selected from thermoset polymers, thermoplastic polymers, and the combinations thereof. Representative thermoplastic fibers include polyamides, polyesters, and polyolefins. Natural fibers include those that are of cellulosic composition, such as wood pulp, cotton, and rayons. The matrix fibers can optionally incorporate one or more fibers of different composition, including other staple fiber blends, or fibers of the same of different composition with variations in the denier and staple length.

Lyocell fibers that can be used primarily include finite staple lengths and continuous filaments. Preferred lyocell fibers, as practiced in the present invention, include those of finite staple length.

The binder fibers that can be used primarily include fibers of homogeneous, heterogeneous, or segmented construction, manufactured from one or more thermoplastic polymers. Representative thermoplastic fibers include polyamides, polyesters, and polyolefins. Preferred binders fibers include polyester staple fibers, of homogeneous, bi-component, or multi-component construction.

The fiber blend can optionally be applied to, or otherwise incorporate, one or more layers of the same or different composition, including other staple fiber blends. Further, the fibers and fiber layers may be combined with one or more layers of continuous filaments, micro-denier filaments or fibers, scrims, and barrier or breathable films.

EXAMPLES

Example 1

A fabric was formed from two, cross-lapped (2 folds) drafted fibrous batts, each fibrous batt comprising: 52.5% by weight 0.99 denier by 1.5 inch T-472 PET fibers, as available from Wellman, 40% by weight 1.5 denier by 1.5 inch rayon Type 8191 as available from Lenzing, as available from Accordis, and 7.5% by weight 3.0 denier by 1.5 inch Type T-410 binder fiber, as available from Foss. The web was hydroentangled on a flat bed entangler 5 by manifold 6 operated at 40 bar. The precursor web was then positioned upon entangler 12 mounted with a foraminous support surface. The web was subjected to the action of water jets from one manifold 10 operated at 50 bar. The precursor web was then positioned upon an entangler 22 mounted with a foraminous support surface. The web was subjected to the action of water jets from manifold 20 operated at 90 bar. The precursor web was then positioned upon entangler 32 mounted with foraminous support surface. The web was subjected to the action of water jets from manifold 30 operated at 100 bar. The precursor web was then positioned upon entangler 42 mounted with a foraminous support surface. The web was subjected to the action of water jets from manifold 40 operated at 100 bar. The precursor web was then positioned upon entangler 52 mounted with foraminous support surface. The web was subjected to the action of water jets form manifold 50 operated at 90 bar.

This precursor web was then positioned on the image transfer device 18 having a forming surface of "tricot" configured as disclosed in U.S. Pat. No. 5,244,711, with the three manifolds, 61 through 63, operated at 80 bar, 80 bar, and 70 bar, respectively. The fabric was dried at an elevated temperature on drum dryer 70. Drum Dryer 70 consisted of three units operated sequentially at 120° C., 150° C., and 205° C., respectfully. The fabric was formed at a line speed of about 70 yards per minute. Final fabric basis weight was 1.85 ounces per square yard.

Example 2

A fabric was formed in accordance with Example 1, wherein in the alternative, two cross-lapped (2 folds) drafted fibrous batts were used, each fibrous batt comprising: 52.5% by weight 0.99 denier by 1.5 inch T-472 PET fibers, as available from Wellman, 40% by weight 1.5 denier by 2.0 inch lyocell fiber H 205-913, as available from Accordis, and 7.5% by weight 3.0 denier by 1.5 inch CELLBOND Type 252 binder fiber, as available from Kosa.

Example 3

A fabric was formed in accordance with Example 1, wherein in the alternative two cross-lapped (2 folds) drafted webs each comprising 62.5% by weight 0.99 denier by 1.5 inch T-472 PET fibers from Wellman, 30% by weight 1.5 denier by 2.0 inch lyocell fiber H 205-913 from Accordis and 7.5% by weight 3.0 denier by 1.5 inch CELLBOND type 252 binder fiber from Kosa.

The following test procedures have been established in connection with nonwoven fabrics.

| | |
|---|---|
| Basis Weight | ASTM D 377 |
| Bulk | ASTM D 5729 |
| MD Tensile Strength | ASTM D 5034 |
| CD Tensile Strength | ASTM D 5034 |
| MD Elongation | ASTM D 5034 |
| CD Elongation | ASTM D 5034 |
| MD tear | ASTM D 5734 |
| CD tea | ASTM D 5734 |
| MD Stiffness | INDA ST 90.0-75 R82 |
| CD Stiffness | INDA ST 90.0-75 R82 |
| Air Permeability | ASTM D 737 |
| Mullen Burst | ASTM D 461 section 13 |
| MD Thermal Shrinkage | See Below |
| CD Thermal Shrinkage | See Below |
| MD Wash Shrinkage | ASTM D2724 |
| CD Wash Shrinkage | ASTM D2724 |

For thermal shrinkage the following procedure was used: Cut four samples across the full width of the fabric. Sample size is 12"×12". Using an AATCC shrinkage scale, mark/draw two lines that are 10" a part in the MD and repeat for the CD. Place sample in oven heated to 350 of for 30 minutes. Remove sample and allow cooling to ambient temperature. Measure using AATCC shrinkage scale.

Tables 1 and 2 provide a comparisons of a conventional rayon nonwoven fabric, Example 1 against the lyocell nonwoven fabric of the present invention, Example 2 and Example 3. The test data shows that lyocell nonwoven fabric approaching, meeting, or exceeding the benchmarks achieved with fabrics formed from a rayon fiber equivalent material. Fabrics formed in accordance with the present invention have been found capable of withstanding no less than 5 laundry machine washing, and preferably greater than 25 laundry machine washing, which is thus suitable for "top-of-bed" applications.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

TABLE 1

| | Example 1 | Example 2 | Comparison Example 1 v. Example 2 (Normalized to basis weight) |
|---|---|---|---|
| Basis Weight | 1.81 | 1.86 | — |
| Bulk | 0.02 | 0.02 | — |
| MDT | 28.31 | 40.68 | 40% |
| CDT | 24.83 | 30.90 | 21% |
| MDE | 20.52 | 34.22 | 62% |
| CDE | 65.30 | 65.72 | −2% |
| MD tear | 916.07 | 1823.50 | 94% |
| CD tear | 1186.37 | 2053.93 | 68% |
| MD Stiff | 57.72 | 52.19 | −12% |
| CD Stiff | 15.19 | 19.23 | 23% |
| Air Perm | 342.84 | 350.10 | −1% |
| Mullen Burst | 66.70 | 84.89 | 24% |
| MD wash shrink | 7.30 | 5.34 | −29% |
| CD wash shrink 5 cycles | 5.50 | 2.95 | −48% |

TABLE 2

| | Basis Weight | MD Tensile | CD Tensile | MD Tear | CD Tear | MD Thermal Shrinkage | CD Thermal Shrinkage |
|---|---|---|---|---|---|---|---|
| Example 1 | 1.81 | 28.1 | 20.5 | 900 | 1100 | 4.25 | 2 |
| Example 2 | 1.86 | 4.07 | 30.9 | 1824 | 2054 | 2 | 1 |
| Example 3 | 1.85 | 39.7 | 31.2 | 1228 | 1512 | 2.25 | 1.75 |

What is claimed is:

1. A top-of-bed nonwoven fabric, comprising:

a carded blend of matrix fibers, lyocell fibers and staple length binder fibers, said fabric being imaged and patterned by hydroentanglement on a three-dimensional image transfer device prior to thermal bonding, and subsequently thermal bonded by heat-activation of said staple length binder fibers, said nonwoven fabric being free of resin binder, and capable of withstanding at least 5 laundry machine washings.

2. A top-of-bed nonwoven fabric, comprising:

a carded blend of matrix fibers, lyocell fibers and staple length binder fibers, said fabric being imaged and patterned by hydroentanglement on a three-dimensional image transfer device prior to thermal bonding, and subsequently thermal bonded by heat-activation of said staple length binder fibers;

said fabric comprising matrix fiber in the range of about 50% to about 75% by weight, lyocell fiber in the range of about 20% to about 45% by weight, and staple length binder fiber in the range of about 3% to about 20% by weight, said nonwoven fabric being free of resin binder, and capable of withstanding at least 5 laundry machine washings.

3. A top-of-bed nonwoven fabric, comprising:

a carded blend of matrix fibers, lyocell fibers and staple length binder fibers, said fabric being imaged and patterned by hydroentanglement on a three-dimensional image transfer device prior to thermal bonding, and subsequently thermal bonded by heat-activation of said staple length binder fibers;

said fabric comprising matrix fiber in the range of about 50% to about 75% by weight, lyocell fiber in the range of about 20% to about 45% by weight, and binder fiber in the range of 5% to 10% by weight, said nonwoven fabric being free of resin binder, and capable of withstanding at least 5 laundry machine washings.

4. A method of using the nonwoven fabric of claim 1, including:

employing said nonwoven fabric for "top-of-bed" applications including comforters, pillows, dust ruffles, and the like.

* * * * *